US006338572B1

(12) United States Patent
Schneck

(10) Patent No.: US 6,338,572 B1
(45) **Date of Patent: *Jan. 15, 2002**

(54) EASY OPEN INDUSTRIAL BAG

(75) Inventor: Gene Douglas Schneck, Rockingham, NC (US)

(73) Assignee: Southern Bag Corporation, Madison, MS (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 221 days.

(21) Appl. No.: 09/207,091

(22) Filed: Dec. 7, 1998

(51) Int. Cl.[7] ..... B65D 33/00

(52) U.S. Cl. ..... 383/205; 383/205; 383/85; 383/211; 383/114

(58) Field of Search ..... 383/205, 88, 114, 383/906, 210, 211, 85

(56) References Cited

U.S. PATENT DOCUMENTS

| | | | | |
|---|---|---|---|---|
| 218,650 | A | 8/1879 | Weaver | |
| 220,510 | A | 10/1879 | Weaver | |
| 2,071,745 | A | 2/1937 | Higginbottom | |
| RE22,490 | E | 5/1944 | Rambold | |
| 2,400,406 | A * | 5/1946 | Godoy | 383/211 |
| 3,074,610 | A | 1/1963 | Pugh | |
| 3,308,996 | A | 3/1967 | Beck | |
| 3,545,668 | A | 12/1970 | Hultberg | |
| 3,557,853 | A | 1/1971 | Jones | 150/7 |
| 3,565,328 | A | 2/1971 | Hudson | |
| 3,687,356 | A | 8/1972 | Goodrich et al. | |
| RE28,317 | E | 1/1975 | Goodrich | |
| RE28,318 | E | 1/1975 | Goodrich | |
| 4,142,667 | A | 3/1979 | Runo | |
| 4,441,613 | A | 4/1984 | Hain et al. | |
| 4,480,752 | A | 11/1984 | Jacobs | |
| 4,483,445 | A | 11/1984 | Lepisto et al. | |
| 4,498,192 | A | 2/1985 | Becker et al. | 383/126 |
| 4,512,479 | A | 4/1985 | Hain et al. | |
| 4,515,273 | A | 5/1985 | Jacobson et al. | |
| 4,557,385 | A | 12/1985 | Robinson | |
| 4,577,761 | A | 3/1986 | Nadaskay | |
| 4,638,912 | A | 1/1987 | Graf | 206/621 |
| 4,744,466 | A | 5/1988 | Hall | |
| 4,871,265 | A | 10/1989 | Peck | 383/89 |
| 4,946,289 | A | 8/1990 | Bolling et al. | 383/61 |
| 4,955,981 | A | 9/1990 | Provost | 383/86 |
| 5,085,724 | A | 2/1992 | Focke | 156/256 |
| 5,478,153 | A | 12/1995 | Feldkämper | 383/114 |
| 5,582,342 | A * | 12/1996 | Jud | 383/205 |
| 5,833,368 | A | 11/1998 | Kaufman | 383/205 |
| 5,855,434 | A | 1/1999 | Hagen | 383/89 |
| 6,048,100 | A | 4/2000 | Thrall et sl. | 383/86 |

FOREIGN PATENT DOCUMENTS

| | | | |
|---|---|---|---|
| CA | 634126 | 1/1962 | |
| CH | 675711 A5 | 10/1990 | B65D/33/18 |
| DE | 803 267 | 2/1951 | |
| EP | 400826 * | 12/1990 | 383/906 |
| GB | 546 782 | 7/1942 | |
| GB | 582 372 | 11/1946 | |

OTHER PUBLICATIONS

International Search Report for Application No. PCT/US99/28774 transmitted Apr. 11, 2000.

* cited by examiner

*Primary Examiner*—Stephen P. Garbe
(74) *Attorney, Agent, or Firm*—Marshall, O'Toole, Gerstein, Murray & Borun

(57) ABSTRACT

An easy open industrial bag includes a tab member secured to a front wall on the exterior of the bag. The tab member is secured between the front wall and a flap formed on a back wall of the bag and folded over and secured to the front wall for closing the bag. The flap is secured with an adhesive disposed in a pattern providing an adhesive void at an opening edge of the bag.

18 Claims, 6 Drawing Sheets

FIG. 12
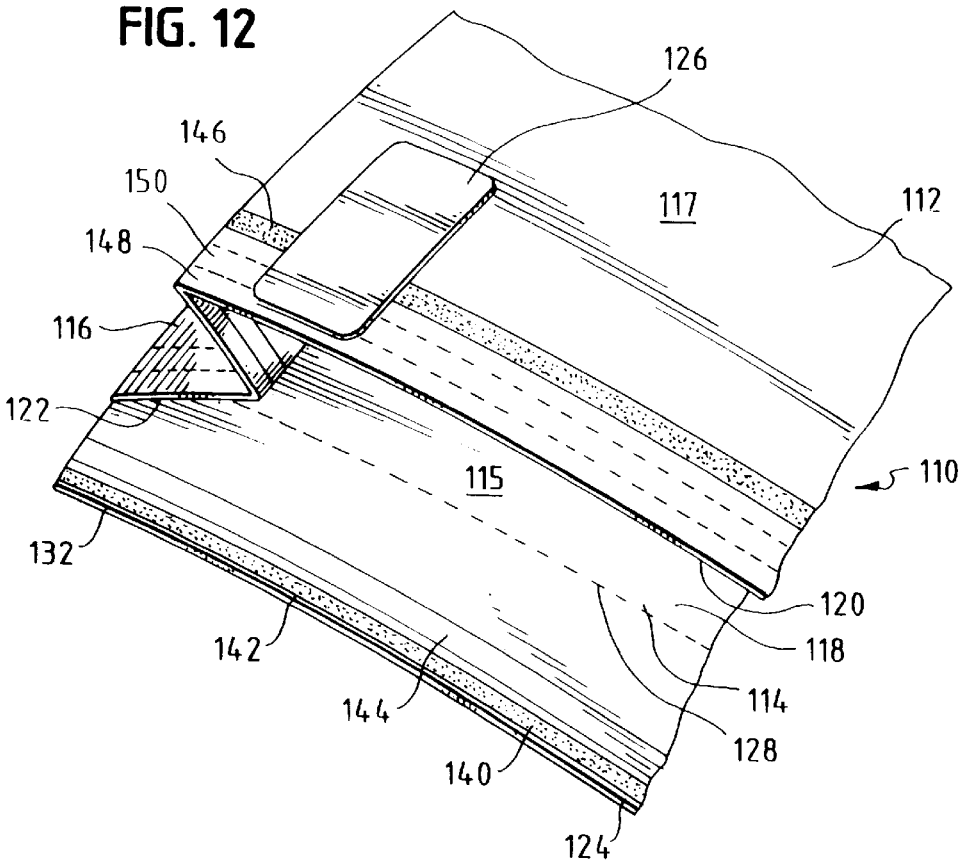
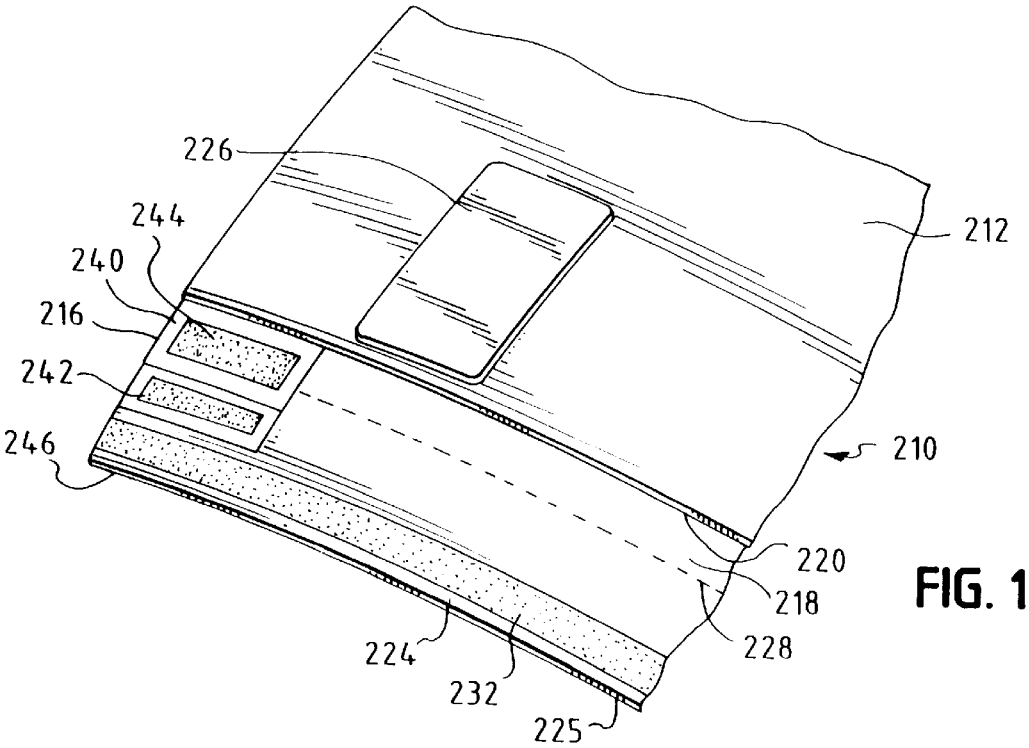
FIG. 13

EASY OPEN INDUSTRIAL BAG

FIELD OF THE INVENTION

The present invention relates generally to industrial bags, and more particularly, the present invention relates to an easy open industrial bag.

BACKGROUND OF THE INVENTION

Industrial bags, often made from multi-ply kraft paper, synthetic sheets, and combinations thereof, are closed in numerous ways. A common closure is referred to as a pinch bottom where a flap of one wall of the bag is folded over and glued or otherwise secured to another wall of the bag. The pinch bottom closure is commonly used in gusseted bags and flat tube bags.

Once closed it becomes necessary at some point to open the bag. In bags that were sewn shut, it is possible to open the bag by undoing the stitching. Sewing generally requires substantial additional processing equipment and processing expense, and thus is no longer a preferred closure method. Providing a glued closure for a pinch bottom bag provides for an easily automated process that is inexpensive and yields a secure sift resistant closure. However, glued closures are difficult to open without cutting the bag, or substantially tearing the walls of the bag. The walls of the bag, of course, are designed to resist tearing, which further makes opening of the bag difficult, and cutting requires having a cutting tool to be handy.

In U.S. Pat. No. 4,480,752 there is disclosed a feature for a pinch bottom bag that facilitates the opening of the bag. The feature includes a tab which is bonded inside the bag within one of the side wall gusset folds. A portion of the tab extends out of the interior of the bag and as the bag is folded closed, remains exposed to the exterior of the bag. By pulling on the tab, the pinch bottom closure is opened in an area surrounding the tab.

In commonly-assigned U.S. patent application Ser. No. 08/768,389, the disclosure of which is hereby expressly incorporated herein by reference, an easy opening feature for industrial bags is also described. A tab is bonded into the bag with a portion extending outwardly from the bag, and the side walls of the bag are formed to include at least one tear line to cause localized tearing of the bag during opening as well as to reduce the effort required to open the bag. In particular embodiments of the bag, tear lines may be formed in both the front and back walls of the bag and arranged so as to align and overlap in a double fold closure.

Disposing the tab within the bag may cause difficulty when the bag is used for particular contents materials. For example, if the bag is to contain pet food, the pet food will typically have a desired fat content. Unless the tab is specially treated, such as coated with silicon or formed from synthetic materials, over time the tab will wick fatty oils from the pet food to the exterior of the bag. The fatty oils make the tab difficult to grasp hindering opening of the bag, may weaken the tab causing it to fail as the bag is opened, may distort printing disposed on the bag and/or the tab, and may further attract insects and rodents. Using silicon coated tabs and or synthetic materials to form the tab presents problems in effectively gluing the bag closed.

SUMMARY OF THE INVENTION

The present invention provides an easy open feature for an industrial bag utilizing a tab disposed on the exterior of the bag in combination with a uniquely glued closure.

In accordance with a preferred embodiment of the present invention, a bag includes a front wall, a back wall, first and second side walls interconnecting the front wall and the back wall, and an enclosed end defining an interior portion aid an exterior portion of the bag. The enclosed end includes a flap formed integral with the back wall that is folded over and bonded to the front wall using adhesive. A tab is secured to the front wall on the exterior of the bag and is disposed between the flap and the front wall. The tab is detachably secured to the front wall and the adhesive is disposed between the front wall and the flap in a pattern defining an adhesive void adjacent an opening edge of the bag.

The bag may also include a tab having a first portion disposed between the second flap and the front wall and a second portion extending along the front wall.

In alternate preferred embodiments, the tab may extend outwardly from beneath the flap, or may end at the edge of the flap.

The tab may also have a multi-ply construction including a first ply and a second ply. The first ply is substantially permanently bonded to the front wall on the exterior of the bag and the second ply is unsecured to the front wall.

The tab may also include a body portion and a tab portion. The body portion is bonded to the front wall and the tab portion extends over an opening edge of the front wall.

The tab may also include apertures through which the flap is bonded to the front wall.

The tab may be secured to the front wall using a peel-free adhesive.

In another aspect of the present invention, a bag includes a front wall, a back wall and first and second side walls interconnecting the front wall and the back wall. Each of the front wall, the back wall and the first and second side walls have a multiply construction, and the front wall and the first and second side walls each having an end edge. The end edges are preferably cut substantially flush, and the back wall has a flap extending from the back wall and beyond the end edges. A tab member is releasably secured to the front wall on an exterior portion of the bag and extends from the end edge along the front wall. An adhesive is disposed on the flap in a substantially continuous pattern, however, leaving a void area adjacent an opening edge of the bag.

BRIEF DESCRIPTION OF THE DRAWINGS

These and other advantages and features of the present invention will become apparent to one of ordinary skill in the bag making art from the following detailed description of several preferred embodiments of the present invention with reference to the attached drawings wherein like reference numerals are used to identify like elements throughout and in which:

FIG. 12 is a partial perspective view of a bag in accordance with an additional alternate preferred embodiment of the present invention; and FIG. 13 is a partial perspective view of a bag in accordance with yet another alternate preferred embodiment of the present invention.

DETAILED DESCRIPTION OF THE PREFERRED EMBODIMENTS

Figure 1:
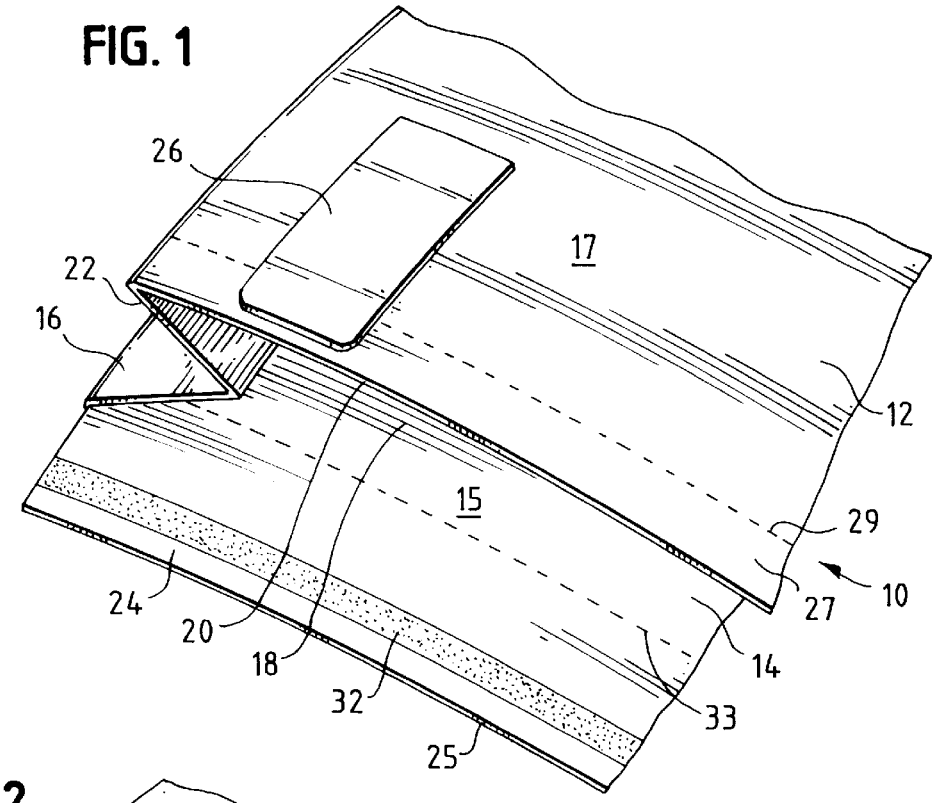
FIG. 1 is a partial perspective view of a bag according to the present invention with the bag end in a pre-closed configuration.

With reference to FIG. 1, a bag 10 includes a front wall 12, a back wall 14 and first and second side walls (one shown as 16) defining an interior 15 and an exterior 17 of bag 10. First and second side walls 16 preferably have a gusseted configuration, although the present invention is readily adaptable to flat-tube bags. Also, while described in terms of a single fold pinch bottom bag, one of ordinary skill in the art will appreciate that the present invention has application to double-fold bags and square end bags. Front wall 12, back wall 14 and first and second side walls 16 are each shown as single ply material; however, as will be appreciated from the discussion of additional preferred embodiments below, multi-layer laminate materials may also be used with the present invention.

With continuing reference to FIG. 1, bag 10 includes an open end 18, and front wall 12, and first and second side walls 16. Front wall 12 includes an end edge 20 and each side wall 1 6 includes an end edge 22. A flap 24 is formed extending from back wall 14 and beyond end edges 20 and 22. A tab member 26 is secured to front wall 12 on the exterior of bag 10, extending from edge 20 along front wall 12 substantially perpendicular to edge 20. A second end of bag 10 (not shown) may be pre-closed or remain open. In preferred embodiments, a bag may be manufactured with an enclosed end including an easy open feature in accordance with the present invention, and the second end is used for filling and is subsequently permanently sealed by the end-user. Of course, the end-user may use open end 18 for filling, and then seal bag 10 in accordance with the present invention once filled.

Figure 2:
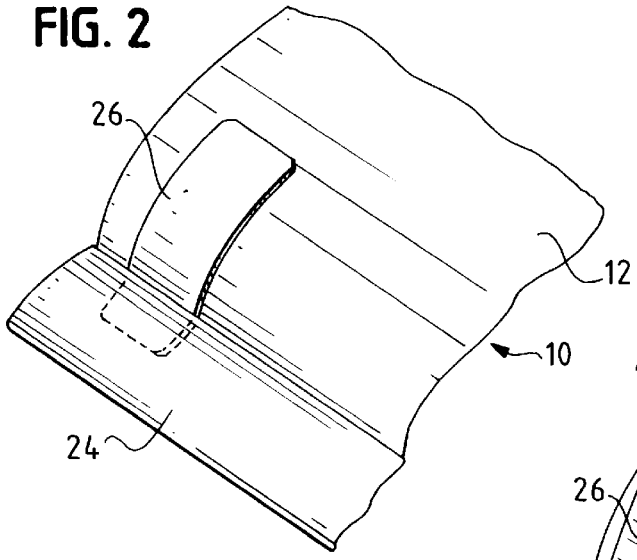
FIG. 2 illustrates the bag shown in FIG. 1 in a closed configuration.

Flap 24 folds along line 23 to form an enclosed end (best seen in FIG. 2). A portion 27 of front wall 12 may also be folded along line 29 and retained beneath flap 24. In the closed configuration, flap 24 engages front wall 12 and is secured thereto by adhesive 32, which is applied in a substantially continuous pattern extending along flap 24 between first and second side walls 16 adjacent edge 25. Tab member 26 extends outwardly along front wall 12 from beneath flap 24. Tab member 26 may be secured to front wall 12 using a relatively strong adhesive, or tab member 26 may be secured to front wall 12 using an adhesive having high shear strength but low tensile strength. Such adhesives are frequently referred to as peel-free adhesives. Peel-free adhesives are advantageous in the present application in view of the fact the most of the stresses to which bag 10 is exposed during folding and use of bag 10 are in shear. Thus, the peel-free adhesive is very effective for retaining tab member 26 to front wall 12, while still permitting easy opening of bag 10.

Figure 3:
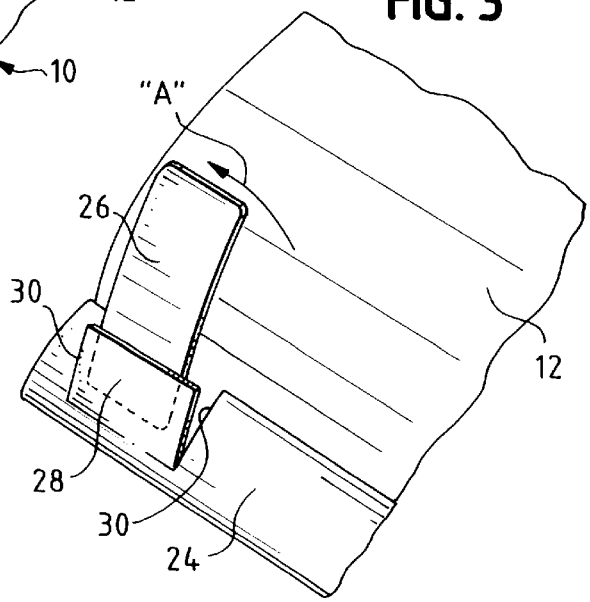
FIG. 3 illustrates the bag shown in FIG. 2 in a partially open configuration.
Figure 4:
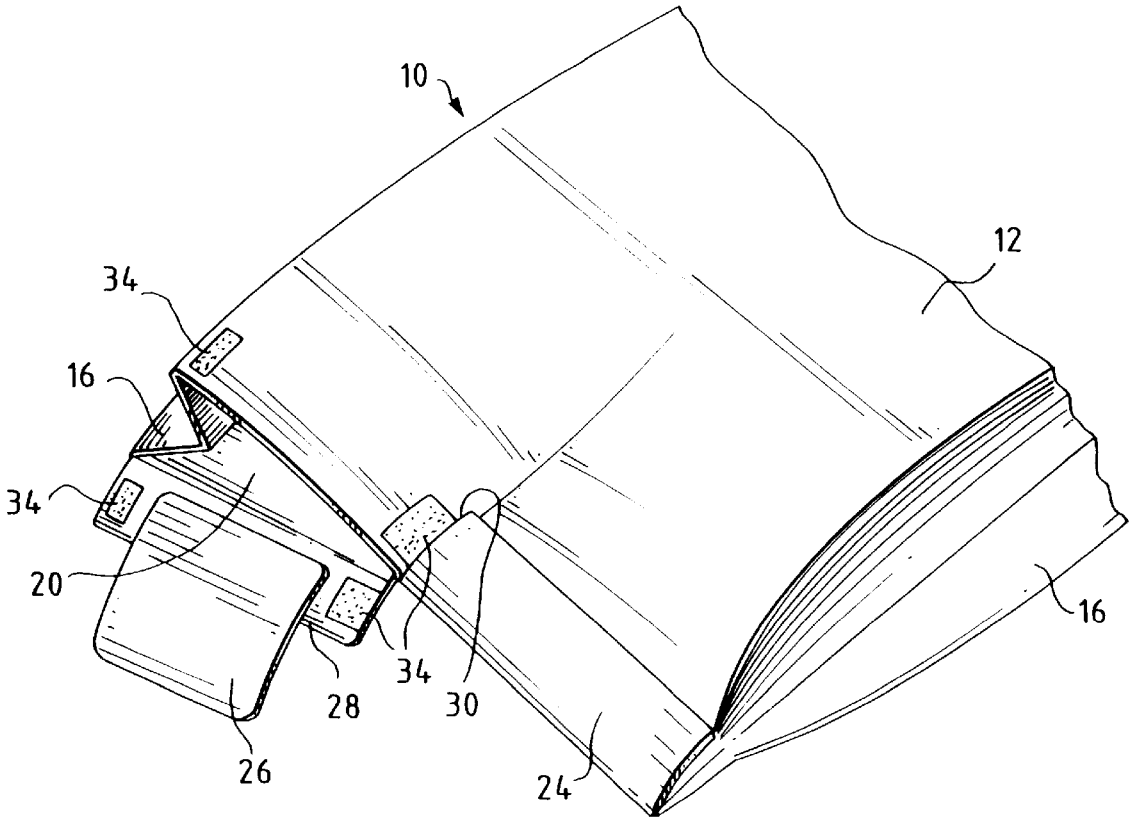
FIG. 4 illustrates the bag shown in FIG. 2 fully opened.

Referring to FIG. 3, tab member 26 is pulled upwardly and forwardly as indicated generally by arrow "A." Pulling tab member 26 in the direction of arrow "A" causes a tearing of flap 24 along tear lines 30 forming a tear away portion 28. The separation of portion 28 from flap 24 permits the opening of bag 10 as shown in FIG. 4. Tab member 26 is retained to portion 28 by adhesive 32 and some delamination of flap 24 and front wall 12 occurs in areas 34. Tab member 26 may be pulled from front wall 12 by separation from its adhesive if a peel-free adhesive is used or as a result of delamination of an outer surface of front wall 12 if a stronger adhesive is used.

Tab member 26 is shown positioned towards one of first and second sides 16, which permits forming a pour spout as shown in FIG. 4. Of course, tab member 26 may be positioned anywhere along flap 24, such as at a center portion to form a center spout. Tab member 26 may further be positioned on an exterior of the bag, but within one of the gusset folds of side walls 16. Moreover, it should be noted that the configuration of tab member 26 shown in the Figures is representative of a possible tab configuration, and virtually any size and shape of tab members may be employed with the present invention.

The present invention has been found to provide easier opening by modifying how flap 24 is secured to front wall 12. With continued reference to FIG. 1, as noted adhesive strip 32 is applied as a substantially continuous strip along flap 24 and preferably closely adjacent to edge 25. This ensures that when flap 24 is folded and engaged with front wall 12, adhesive 32 does not bridge opening 18 which may cause edge 20 to bond to back wall 14 substantially impairing opening of bag 10.

Figure 5:
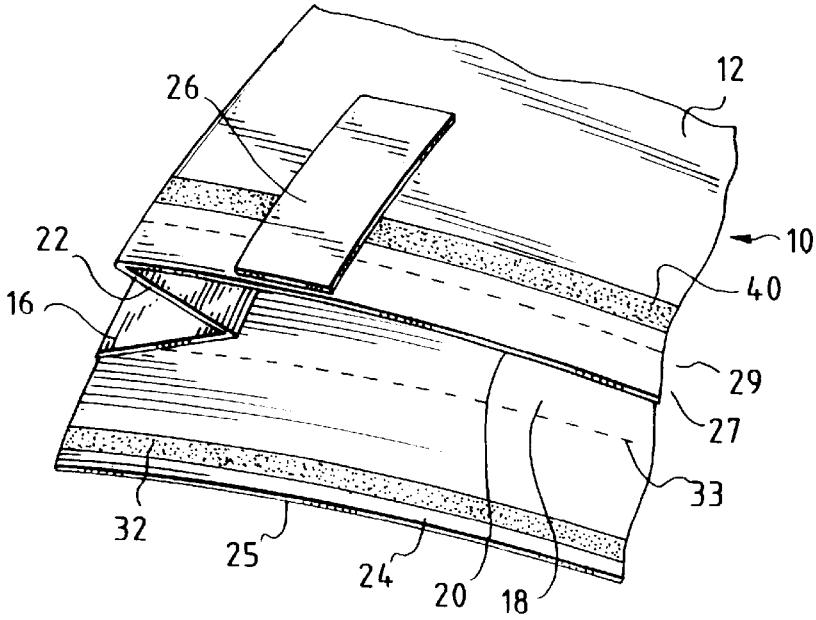
FIG. 5 illustrates the bag shown in FIG. 1 and further illustrating ar alternate preferred glue pattern for effecting closure of the bag.

As shown in FIG. 5, an additional substantially continuous strip of adhesive 40 may be applied to front wall 12, displaced from edge 20. Tab member 26 is shown disposed over adhesive 40, but it will be appreciated that tab member 26 may be first applied to front wall 12 and adhesive 40 applied over tab member 26. By positioning adhesive 32 adjacent edge 25 and adhesive 40 displaced from edge 20, upon sealing bag 10 by folding flap 24 into engagement with front wall 12, neither adhesive 32 nor adhesive 40 bridges opening 18. This "adhesive void" adjacent opening 18 ensures that bag 10 may be easily opened once tab member 26 is used to tear open portion 28 of flap 24. In an alternative preferred embodiment, portion 27 may be coated with silicone or similar material. In this embodiment, adhesive coming into contact with the coating disposed on portion 27 will not substantially adhere effectively providing the desired adhesive void adjacent opening 18.

For a bag to be opened such as shown in FIG. 4, the adhesive void may be limited to a local area adjacent tab member 26. In this manner, adhesive 32 and 40 may be applied in a pattern such that it is adjacent and does bridge opening 18 away from tab member 26 but forms the desired adhesive void in the vicinity of tab member 26. Similarly, silicone or other coatings may be applied to front wall 12 in local areas where opening of bag 10 is desired. Still further, it is possible to coat tab member 26 itself with silicone or a similar material to inhibit bonding of flap 24 to tab member 26, and hence front wall 12, adjacent opening 18 for forming the adhesive void.

Figure 6:
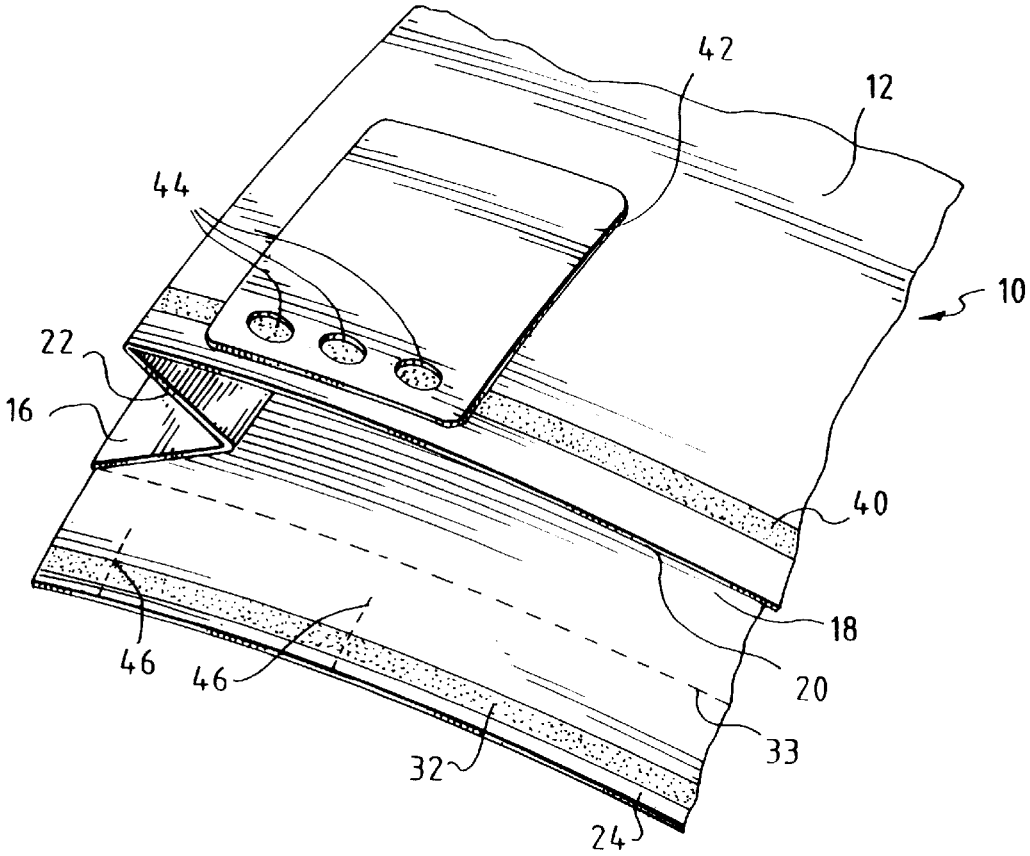
FIG. 6 illustrates the bag shown in FIG. 1 and further illustrates an alternate preferred tab member.

The adhesive void may not be acceptable in all application of bag 10 because the adhesive void weakens bag 10. The weakening of bag 10 created by the adhesive void is desirable for facilitating opening the bag, but it may adversely effect using the bag in certain applications. As shown in FIG. 6, a tab member 42 is formed with a plurality of apertures 44. Apertures 44 permit bonding of flap 24 to front wall 12 in the area of apertures 44 and through tab member 42. Permitting bonding of flap 24 to front wall 12 through apertures 44 substantially strengthens bag 10 over providing an adhesive void for the entirety of tab member 42. As a further enhancement, and to ensure tearing of flap 24 in the region of tab member 26, it may be desirable to provide tear lines, perforations or weakened areas 46 in flap 24 to ensure tearing adjacent tab member 26.

Figure 7:
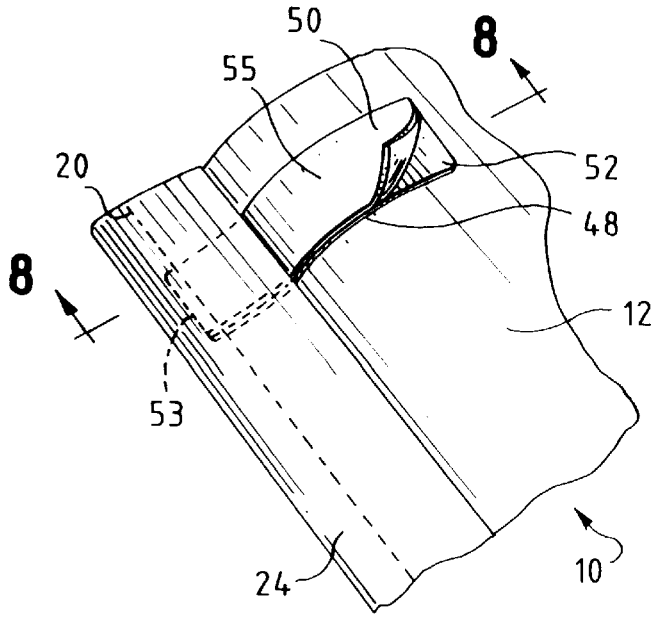
FIG. 7 illustrates the bag shown in FIG. 1 in a closed configuration and further illustrates another alternate preferred tab member.
Figure 8:
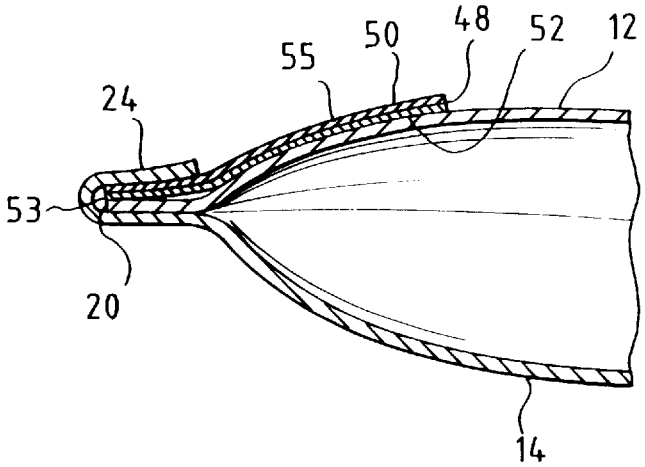
FIG. 8 is cross-section view taken along line 8—8 of FIG. 7.

Providing an adhesive void also may not be suitable for applications in which sifting leakage is a problem. The adhesive void provides a path through which fine particles may leak from bag 10 and/or may provide an entry point for insects or contaminants. With reference to FIG. 7 and FIG. 8 a multi-ply tab member 48 including a first ply 50 and a second ply 52 is used in conjunction with bag 10. Second ply 52 is substantially permanently bonded to front wall 12. First ply 50 is secured to second ply 52 using a peel-free adhesive. Tab member 48 is secured to front wall 12 with a portion 53 overlapping edge 20 and a second portion 55 extending outwardly along front wall 12 from beneath flap 24. To open bag 10, first ply 50 is separated from second ply 52 and pulled upwardly causing tearing of flap 24 adjacent to tab member 48. Because second ply 52 is bonded to front wall 12, first ply 50 is bonded to second ply 52 and flap 24 is bonded first ply 50, substantially complete, sift resistant sealing of bag 10 is provided. By providing portion 53 overlapping edge 20, an effective adhesive void is created adjacent opening 18 facilitating opening of bag 10.

Figure 9:
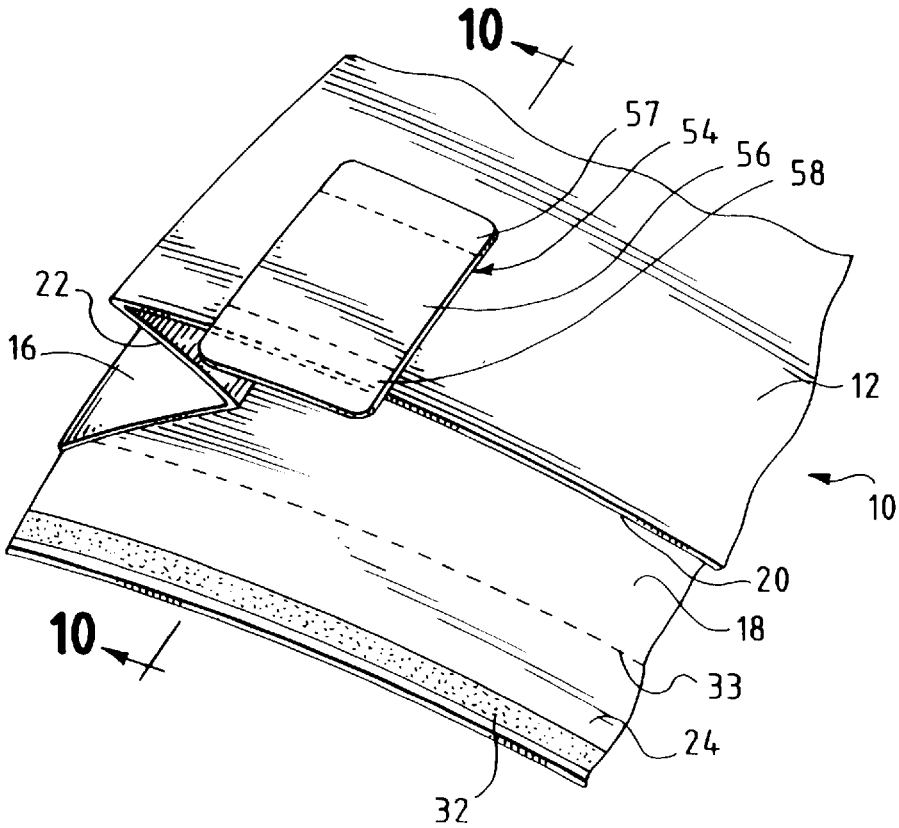
FIG. 9 illustrates the bag shown in FIG. 1 and further illustrates an alternate preferred tab member.
Figure 10:
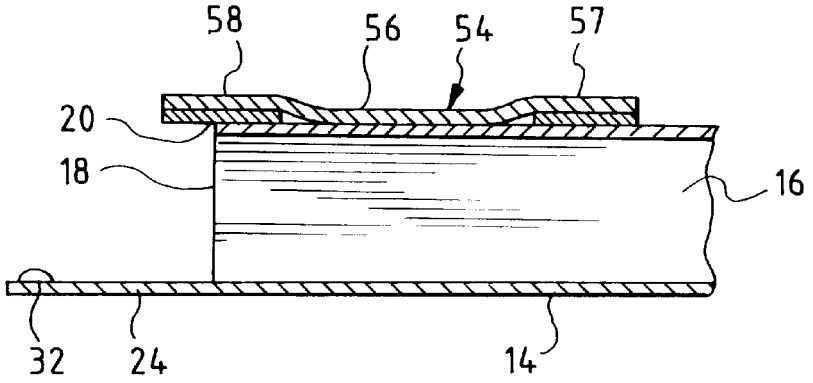
FIG. 10 is a cross-section view taken along line 10—10 of FIG. 9.

With reference to FIG. 9 and FIG. 10, a tab member 54, which also provides resistance to sift leakage, includes a body portion 56, a first tab portion 57 and a second tab portion 58. Tab member 54 is positioned to front wall 12 such that second tab portion 58 overlaps edge 20. Second tab portion 58 is not bonded to front wall 12, and in this manner second tab portion 58 forms the adhesive void that facilitates opening of bag 10. Body portion 56 extends along front wall 12 from end edge 20 and substantially perpendicular thereto and includes adhesive for securing tab member 54 to front wall 12. First tab portion 57 is also unsecured to front wall 12, and it permits easy grasping of tab member 54 for opening bag 10. Preferably, tab member 54 is made from label stock having a label substrate with adhesive on one side and a release backing covering the adhesive. The release backing is preferably die cut or otherwise segmented such that a portion adjacent tab portion 56 may be removed to expose the adhesive, while portions adjacent each of first and second tab portions 57 and 58 remain secured to the substrate. The adhesive may then be advantageously used to secure tab member 54 to front wall 12 as described. The label stock may be further advantageously printed with opening instructions, coupon information and the like.

Figure 11:
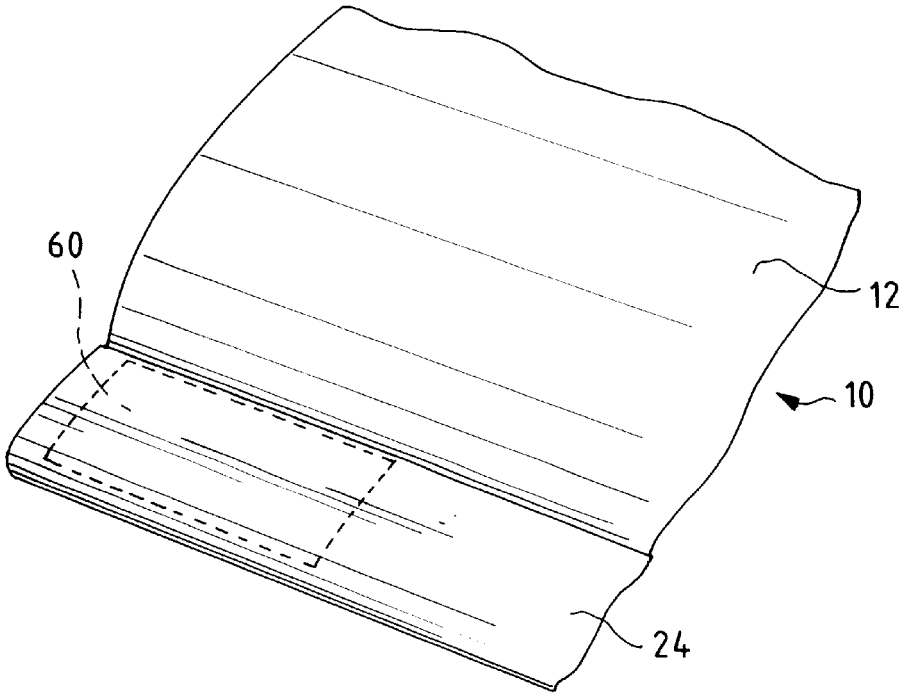
FIG. 11 is an illustration of the bag shown in FIG. 1 in a close configuration and further illustrates another alternate preferred tab member.

Referring to FIG. 11, still another alternate tab member 60 is shown. Tab member 60 is disposed substantially completely under flap 24. This arrangement prevents inadvertent removal of the tab member and/or inadvertent opening of bag 10. To open bag 10 adapted with tab member 60, a user places a finger or fingers under flap 24 in the area of tab 60 and lifts upwardly tearing flap 24. Tab member 60 is preferably secured to front wall 12 using a peel-free adhesive which allows easy separation of tab member 60 from front wall 12 allowing the user to insert a finger underneath tab member 60 for opening the bag.

With reference now to FIG. 12, a bag 110 includes a front wall 112, a back wall 114 and first and second side walls (one shown as 116) defining an interior 115 and exterior 117 of bag 110. Each of front wall 112, back wall 114 and first and second side walls 116 are of a multi-ply construction, and first and second side walls 116 further preferably have a gusseted configuration. Bag 110 includes an open end 118, and front wall 112, and first and second side walls 116 each include end edges 120 and 122, respectively. A flap 124 is formed extending from back wall 114 and beyond end edges 120 and 122. A tab member 126 is secured to front wall 112 on the exterior of bag 110, extending from end edge 120.

Flap 124 folds along line 128 to form an enclosed end. In the closed configuration, flap 124 engages front wall 112 and is secured thereto by adhesive 132, which is applied in a substantially continuous pattern extending along a first lamination 142 and potentially each lamination of flap 124 between first and second side walls 116. A substantially continuous pattern of adhesive 140 is also applied to a lamination 146 of front wall 112. Preferably adhesive 140 is applied to an outermost lamination 146 of front wall 112 displaced from edge 120, leaving one or more of the inner laminations 148 and 150 adhesive free. Similarly, adhesive 132 is preferably applied to outer most laminations, e.g., laminations 142 and 144, and adjacent edge 125. As will be appreciated, this arrangement of adhesive 132 and 140 assures adhesive does not bridge opening 118 thereby providing an adhesive void that facilitates opening of bag 110.

With reference to FIG. 13, a bag 210 includes a front wall 212, a back wall 214 and first and second side walls (one shown as 216). Each of front wall 212, back wall 214 and first and second side walls 216 are shown of single ply construction, but may be of a multi-ply construction, and first and second side walls 216 further preferably have a gusseted configuration. Bag 210 includes an open end 218, and front wall 212, and first and second side walls 216 each include an end edge 220 and 222, respectively. A flap 224 is formed extending from back wall 214 and beyond end edges 220 and 222. A tab member 226 is secured to front wall 212 on the exterior of bag 210, extending from end edge 220.

Flap 224 folds along line 228 to form an enclosed end. In the closed configuration, flap 224 engages front wall 212 and is secured thereto by adhesive 232, which is applied in a substantially continuous pattern extending along flap 224 between first and second side wall 216 and adjacent edge 225. End edges 222 of first and second side walls 216 have "long edges" or stepped plies 240 and 242. Adhesive 244 and 246 is applied to each of stepped plies 240 and 242. Preferably, stepped plies 240 and 242 extend sufficiently far along flap 224 that during application of adhesive 232, adhesive is also applied to each. In the closed configuration, stepped plies 240 and 242 are bonded to front wall 212 securing the gusset portion of first and second side walls 216 to further strengthen bag 210, while tab member 226 provides for easy opening of bag 210 in accordance with the present invention.

The present invention has been described in terms of several preferred embodiments directed to pinch bottom bags. It will be appreciated that the present invention may be adapted to other bag types apart from pinch bottom bags. The present invention may also be incorporated into closed bag ends as provided from the manufacturing facility, and/or may be incorporated into the bag by the end-user after filling. Still further the tab members may be printed to provide opening instructions, discount coupons, and the like. The above-described preferred embodiments are intended to be illustrative of the broad scope of the invention, which is defined by the sub-joined claims.

I claim:

1. A bag comprising a front wall, a back wall, first and second side walls interconnecting the front wall and the back wall, defining an interior and an exterior of the bag, and an enclosed end;

the enclosed end comprising a flap formed integral with the back wall and further being folded over and engaging the front wall and secured thereto by an adhesive;

a tab secured to the front wall on the exterior and disposed within the enclosed end between the flap and the front wall, the tab being detachably secured to the front wall, the tab being formed to include at least one aperture, wherein the flap is secured to the front wall within the at least one aperture; and the adhesive disposed in a pattern having an adhesive void adjacent an opening edge of the front wall.

2. The bag of claim 1, wherein a first portion of the tab is disposed between the flap and the front wall and a second portion extends along the front wall.

3. The bag of claim 1, wherein the first portion overlaps the opening edge.

4. The bag of claim 1, wherein the tab extends outwardly from beneath the flap.

5. The bag of claim 1, wherein the tab comprises a first ply and a second ply, the first ply being bonded to the front wall and the second ply being unsecured to the front wall.

6. The bag of claim 5, wherein the second ply overlaps the opening edge.

7. The bag of claim 1, wherein the tab is secured to the front wall by a peel-free adhesive.

8. The bag of claim 1, wherein the adhesive pattern comprises first portion of adhesive disposed on the flap and a second portion of adhesive disposed on the front wall.

9. A bag comprising a front wall, a back wall and first and second side walls interconnecting the front wall and the back wall, defining an interior and an exterior of the bag, each of the front wall, the back wall and the first and second side walls having a multi-ply construction, the front wall and the first and second side walls each having an end edge, wherein the end edges are cut substantially flush, and the back wall as a flap extending from the back wall and beyond the end edges;

a tab member releasably secured to the front wall on the exterior and extending from the end edge; and an adhesive disposed on the flap and extending in a pattern extending substantially continuously from the first side wall to the second side wall and adjacent a flap edge to define an adhesive void adjacent an opening edge of the front wall.

10. The bag of claim 9, wherein the tab member is secured to the front wall by a peel-free adhesive.

11. The bag of claim 9, wherein the tab member extends from the end edge of the front wall a length in excess of a length of the flap.

12. The bag of claim 9, wherein the tab member includes a portion that overlaps the opening edge.

13. The bag of claim 9, wherein the first and second side wall comprise stepped-plies extending from the end edge.

14. The bag of claim 9, the tab member comprising a first ply and a second ply, the first ply being substantially permanently bonded to the front wall and the second ply being unsecured to the front wall.

15. The bag of claim 14, wherein the second ply overlaps the opening edge.

16. The bag of claim 9, the tab member comprising having a first portion disposed between the flap and the front wall and a second portion extending outwardly from beneath the flap and along the front wall.

17. The bag of claim 16, the first portion formed to include at least one aperture and the adhesive being disposed within the aperture.

18. The bag of claim 9, further comprising adhesive disposed on the front wall in a pattern extending substantially continuously from the first side wall to the second side wall and displaced from the opening edge to define an adhesive void adjacent the opening edge.

* * * * *